US007315722B2

(12) United States Patent
Kitajima et al.

(10) Patent No.: US 7,315,722 B2
(45) Date of Patent: Jan. 1, 2008

(54) IMAGE FORMING APPARATUS AND IMAGE FORMING METHOD

(75) Inventors: Ryoichi Kitajima, Numazu (JP); Hidetoshi Kami, Numazu (JP); Yoshiaki Kwasaki, Susono (JP); Naohiro Toda, Yokohama (JP); Maiko Kondoh, Ebina (JP); Hiroshi Nagame, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 427 days.

(21) Appl. No.: 11/016,708

(22) Filed: Dec. 21, 2004

(65) Prior Publication Data

US 2005/0141919 A1 Jun. 30, 2005

(30) Foreign Application Priority Data

Dec. 25, 2003 (JP) ..... 2003-429839

(51) Int. Cl.
*G03G 21/00* (2006.01)

(52) U.S. Cl. ..... 399/353; 399/159

(58) Field of Classification Search ..... 430/66; 399/159, 353

See application file for complete search history.

(56) References Cited

U.S. PATENT DOCUMENTS

| | | | | |
|---|---|---|---|---|
| 4,740,441 | A | | 4/1988 | Otomura |
| 4,942,104 | A | | 7/1990 | Kitajima et al. |
| 5,008,172 | A | * | 4/1991 | Rokutanzono et al. ..... 430/67 |
| 5,059,502 | A | | 10/1991 | Kojima et al. |
| 5,147,751 | A | | 9/1992 | Kojima et al. |
| 5,264,903 | A | | 11/1993 | Nagame et al. |
| 5,339,138 | A | | 8/1994 | Mishima et al. |
| 5,390,015 | A | | 2/1995 | Nagame et al. |
| 5,452,061 | A | | 9/1995 | Kojima et al. |
| 5,525,447 | A | | 6/1996 | Ikuno et al. |
| 5,656,406 | A | | 8/1997 | Ikuno et al. |
| 5,840,455 | A | | 11/1998 | Ikuno et al. |
| 5,870,657 | A | | 2/1999 | Nagame et al. |
| 5,871,876 | A | | 2/1999 | Ikuno et al. |
| 6,014,532 | A | | 1/2000 | Takeichi et al. |
| 6,030,733 | A | | 2/2000 | Kami et al. |
| 6,060,205 | A | | 5/2000 | Takeichi et al. |
| 6,118,964 | A | | 9/2000 | Kojima et al. |
| 6,151,468 | A | | 11/2000 | Kami et al. |
| 6,160,977 | A | | 12/2000 | Takeichi et al. |

(Continued)

FOREIGN PATENT DOCUMENTS

| | | |
|---|---|---|
| JP | 01-116677 | 5/1989 |

(Continued)

*Primary Examiner*—John L Goodrow
(74) *Attorney, Agent, or Firm*—Oblon, Spivak, McClelland, Maier & Neustadt, P.C.

(57) ABSTRACT

An image forming apparatus, including an electrophotographic photoreceptor including: an electroconductive substrate, a photosensitive layer overlying the electroconductive substrate, and a protective layer overlying the photosensitive layer and serving as an outermost layer, wherein the protective layer has an average abraded thickness not greater than 1 μm after the electrophotographic image forming apparatus produces 100,000 images; a charger charging the electrophotographic photoreceptor; an irradiator irradiating the electrophotographic photoreceptor to form an electrostatic latent image thereon; an image developer developing the electrostatic latent image with a toner to form a toner image on the electrophotographic photoreceptor; a transferer transferring the toner image onto a transfer sheet; and a cleaner cleaning a surface of the electrophotographic photoreceptor, wherein the cleaner comprises a cleaning brush impregnated with a resin.

11 Claims, 3 Drawing Sheets

U.S. PATENT DOCUMENTS

| | | | |
|---|---|---|---|
| 6,326,112 | B1 | 12/2001 | Tamura et al. |
| 6,363,237 | B1 | 3/2002 | Nagame et al. |
| 6,521,386 | B1 | 2/2003 | Sakon et al. |
| 6,521,387 | B2 | 2/2003 | Kawasaki |
| 6,558,862 | B2 | 5/2003 | Kojima et al. |
| 6,558,863 | B2 | 5/2003 | Rokutanzono et al. |
| 6,562,529 | B1 | 5/2003 | Kojima et al. |
| 6,573,016 | B2 | 6/2003 | Kami et al. |
| 6,593,048 | B2 | 7/2003 | Sasaki et al. |
| 6,641,964 | B2 | 11/2003 | Ikuno et al. |
| 6,653,033 | B1 | 11/2003 | Kami et al. |
| 6,667,141 | B2 | 12/2003 | Iwamoto et al. |
| 6,686,114 | B2 | 2/2004 | Sakon et al. |
| 6,699,632 | B2 | 3/2004 | Higuchi et al. |
| 6,706,459 | B2 | 3/2004 | Kojima et al. |
| 6,790,572 | B2 | 9/2004 | Tamoto et al. |
| 6,790,575 | B2 | 9/2004 | Sasaki et al. |
| 6,811,944 | B2 | 11/2004 | Higuchi et al. |
| 6,813,461 | B2 | 11/2004 | Higuchi et al. |
| 6,824,939 | B2 | 11/2004 | Kurimoto et al. |
| 2002/0081513 | A1 | 6/2002 | Higuchi et al. |
| 2002/0159797 | A1 | 10/2002 | Matsuda et al. |
| 2003/0077531 | A1 | 4/2003 | Suzuki et al. |
| 2003/0082472 | A1 | 5/2003 | Kondo et al. |
| 2003/0099481 | A1 | 5/2003 | Sampe et al. |
| 2003/0108362 | A1 | 6/2003 | Ohjimi et al. |
| 2003/0113642 | A1 | 6/2003 | Kami et al. |
| 2003/0152854 | A1 | 8/2003 | Kojima et al. |
| 2003/0165760 | A1 | 9/2003 | Higuchi et al. |
| 2003/0194627 | A1 | 10/2003 | Ikegami et al. |
| 2003/0215726 | A1 | 11/2003 | Sugino et al. |
| 2004/0028435 | A1 | 2/2004 | Kurimoto et al. |
| 2004/0048178 | A1 | 3/2004 | Ikuno et al. |
| 2004/0053149 | A1 | 3/2004 | Toda et al. |
| 2004/0053154 | A1 | 3/2004 | Tomita et al. |
| 2004/0076443 | A1 | 4/2004 | Suzuki et al. |
| 2004/0120730 | A1 | 6/2004 | Niimi et al. |
| 2004/0126147 | A1 | 7/2004 | Kondo et al. |
| 2004/0126686 | A1 | 7/2004 | Toda et al. |
| 2004/0126687 | A1 | 7/2004 | Ikegami et al. |
| 2004/0126689 | A1 | 7/2004 | Tamoto et al. |
| 2004/0142265 | A1 | 7/2004 | Tomita et al. |
| 2004/0146795 | A1 | 7/2004 | Emoto et al. |
| 2004/0185358 | A1 | 9/2004 | Kami |
| 2004/0209181 | A1 | 10/2004 | HIguchi et al. |
| 2004/0229147 | A1 | 11/2004 | Higuchi et al. |
| 2004/0234294 | A1 | 11/2004 | Nagame et al. |
| 2004/0234875 | A1 | 11/2004 | Toda et al. |

FOREIGN PATENT DOCUMENTS

| | | |
|---|---|---|
| JP | 03-077989 | 4/1991 |
| JP | 03-078782 | 4/1991 |
| JP | 06-236134 | 8/1994 |
| JP | 07-155222 | 6/1995 |
| JP | 08-248851 | 9/1996 |
| JP | 09-022155 | 1/1997 |
| JP | 11-167224 | 6/1999 |
| JP | 2001-242578 | 9/2001 |
| JP | 2002-055582 | 2/2002 |

* cited by examiner

IMAGE FORMING APPARATUS AND IMAGE FORMING METHOD

BACKGROUND OF THE INVENTION

1. Field of the Invention

The present invention relates to an electrophotographic image forming apparatus and a process cartridge therefor, which are applicable to copiers, facsimiles, laser printers, direct digital platemakers, etc.

2. Discussion of the Background

An inorganic photoreceptor formed from selenium, zinc oxide or cadmium sulfate was mostly used as an electrophotographic photoreceptor for use in an electrophotographic image forming apparatus applicable to a copier and a laser printer, and now an organic photoreceptor is more widely used than the inorganic photoreceptor because of less damaging the global environment, its low cost and design freedom.

The organic photoreceptor is classified to (1) a uniform single-layered photoreceptor wherein a photoconductive resin typified by polyvinylcarbazole (PVK) or a charge transfer complex typified by PVK-TNF (2,4,7-trinitrofluorenone) is formed on an electroconductive substrate; (2) a dispersion single-layered photoreceptor wherein a resin including a dispersed pigment such as phthalocyanine and perylene is formed on an electroconductive substrate; and (3) a multilayered photoreceptor wherein a photosensitive layer formed on an electroconductive substrate is functionally separated to a charge generation layer (CGL) including a charge generation material such as an azo pigment and a charge transport layer (CTL) including a charge transport material such as triphenylamine.

The multilayered photoreceptor includes a photoreceptor including a CTL on a CGL and a photoreceptor including a CGL on a CTL. The former is typically used and the latter is occasionally called a reversely-layered photoreceptor. Particularly, the multilayered photoreceptor has an advantage of having higher sensitivity and design freedom for higher sensitivity and durability. Therefore, most of the organic photoreceptors are multilayered.

As an importance of manufacturing in consideration of global environmental protection increases recently, a photoreceptor is required to change to a machine part from a supply product (a disposable product). Therefore, the photoreceptor needs to have a long life, and a protective layer is typically formed on a photosensitive layer thereof.

As a toner for developing in electrophotography, a polymerized toner, a spheric toner, a toner having a small particle diameter (approximately 6 μm or less) and a low-temperature fixable toner are mostly used to less damage the global environment when the toner is produced, to consume less electricity and to produce high-quality images.

On the other hand, as a method of removing a toner remaining on a photoreceptor, a method of scraping the toner off from the surface of a photoreceptor with the edge of a cleaning blade formed of an elastic body such as a rubber, which is contacted thereto upon application of pressure, is widely known.

The smaller the particle diameter of a toner, the more difficult to remove the toner from a photoreceptor. Particularly when a cleaning blade is used, the smaller the diameter, the more toners scrape therethrough. Therefore, the a cleaning brush is often used together therewith.

The cleaning brushes are broadly classified to leiotrichous brushes as disclosed in Japanese Laid-Open Patent Publications Nos. 7-155222, 6-236134, 9-22155 and 11-167224; and loop brushes as disclosed in Japanese Patents Nos. 2793647 and 2619424. In addition, a combination thereof as disclosed in Japanese Patent No. 28688539 is also available.

The brushes are formed of a nylon fiber, a polyester fiber, an acrylic fiber, a carbon fiber, etc.

Cleanability of the leiotrichous brushes deteriorates because the fibers thereof droop as they are used. Although the loop brushes have better cleanability than the leiotrichous brushes, the cleanability thereof also deteriorates because toners go into loop holes and adhere thereto to clog the holes.

A combination of the cleaning brush and blade is effectively used to enhance the cleanability.

Cleaning blades formed of a plate substrate made of aluminum or iron a rectangle rubber sheet having a thickness of from 1 to 5 mm is fixed on are suggested in Japanese Laid-Open Patent Publications Nos. 8-248851, 2001-242758and2002-055582.

The rubbers have a reaction elastic modulus of from 30 to 60%. However, the rubbers have a different rubber hardness (JIS-A hardness), from 50 to 90°, i.e., the rubbers have a hardness of 60 to 85°, 50 to 90° and 50 to 80° in Japanese Laid-Open Patent Publications Nos. 8-248851, 2001-242758 and 2002-055582 respectively.

A polyurethane rubber used as a blade material particularly having high durability, very good adhesiveness to an organic photoreceptor and high cleanability is preferably used to clean a residual powder such as a toner.

However, when an additive included in a toner, particularly a wax or a particulate inorganic oxide, release and separate therefrom, and adhere to the surface thereof, such an additive is difficult to remove with a conventional cleaner from a photoreceptor and remains thereon, resulting in so-called filming wherein the additive is firmly fixed thereon upon application of pressure and frictional heat of the blade.

Further, the particulate inorganic oxide is buried on the surface of the photoreceptor, which causes accumulation of the toner, additives thereof or a paper powder of a transfer paper, resulting in filming.

Such filming impairs removal of a discharge product and a paper powder of a transfer paper sticking to the surface of the photoreceptor, and a moisture in the air also sticks thereto to decrease the resistance thereof, resulting in serious problems such as deterioration of image resolution and image distortion.

When a cleaner combining the cleaning blade and brush, the cleaning brush forcibly removes foreign particles difficult to remove with the blade, but a thin film firmly fixed on the surface of a photoreceptor, such as filming, can scarcely be removed.

To remove the filming, the surface of the photoreceptor is slightly chipped off with the cleaning blade and brush, which are adjusted to do so. However, the photoreceptor is abraded due to repeated use and noticeably has a short life.

However, as mentioned above, due to recent requirements for higher durability of the photoreceptor, the protective layer having good abrasion resistance is typically formed on the photosensitive layer thereof.

Although the protective layer improves the abrasion resistance of a photoreceptor and extends the life thereof, it is difficult to remove the filming by slightly chipping off the surface of the photoreceptor.

Because of these reasons, a need exists for an image forming apparatus capable of keeping producing high quality and resolution images using a heavy duty photoreceptor having high abrasion resistance, wherein the filming is prevented before occurs.

SUMMARY OF THE INVENTION

Accordingly, an object of the present invention is to provide an image forming apparatus, an image forming method, a process cartridge and a tandem-type full-color image forming apparatus using an intermediate transfer, wherein a heavy duty photoreceptor having high abrasion resistance and the filming is prevented before occurs.

This object and other objects of the present invention, either individually or collectively, have been satisfied by the discovery of an electrophotographic image forming apparatus comprising:

an electrophotographic photoreceptor comprising:

an electroconductive substrate, a photosensitive layer located overlying the electroconductive substrate, and a protective layer located overlying the photosensitive layer;

a charger charging the electrophotographic photoreceptor;

an irradiator configured to irradiate the electrophotographic photoreceptor to form an electrostatic latent image thereon;

an image developer configured to develop the electrostatic latent image with a toner to form a toner image on the electrophotographic photoreceptor;

a transferer configured to transfer the toner image onto a transfer sheet; and a cleaner configured to clean a surface of the electrophotographic photoreceptor, wherein the protective layer has an average abrasion thickness not greater than 1 μm after electrophotographic image forming apparatus produces 100,000 images, and wherein the cleaner comprises a resin-impregnated cleaning brush.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides an image forming apparatus capable of keeping producing high quality and resolution images using a heavy duty photoreceptor having high abrasion resistance, wherein the filming is prevented before occurs, most preferably all of these characteristics.

More particularly, the present invention relates to an electrophotographic image forming apparatus comprising:

an electrophotographic photoreceptor comprising:

an electroconductive substrate, a photosensitive layer located overlying the electroconductive substrate, and a protective layer located overlying the photosensitive layer, a charger configured to charge the electrophotographic photoreceptor;

an irradiator configured to irradiate the electrophotographic photoreceptor to form an electrostatic latent image thereon;

an image developer configured to develop the electrostatic latent image with a toner to form a toner image on the electrophotographic photoreceptor;

a transferer configured to transfer the toner image onto a transfer sheet; and a cleaner configured to clean a surface of the electrophotographic photoreceptor, wherein the protective layer has an average abrasion thickness not greater than 1 μm after electrophotographic image forming apparatus produces 100,000 images, and wherein the cleaner comprises a resin-impregnated cleaning brush.

Figure 1:
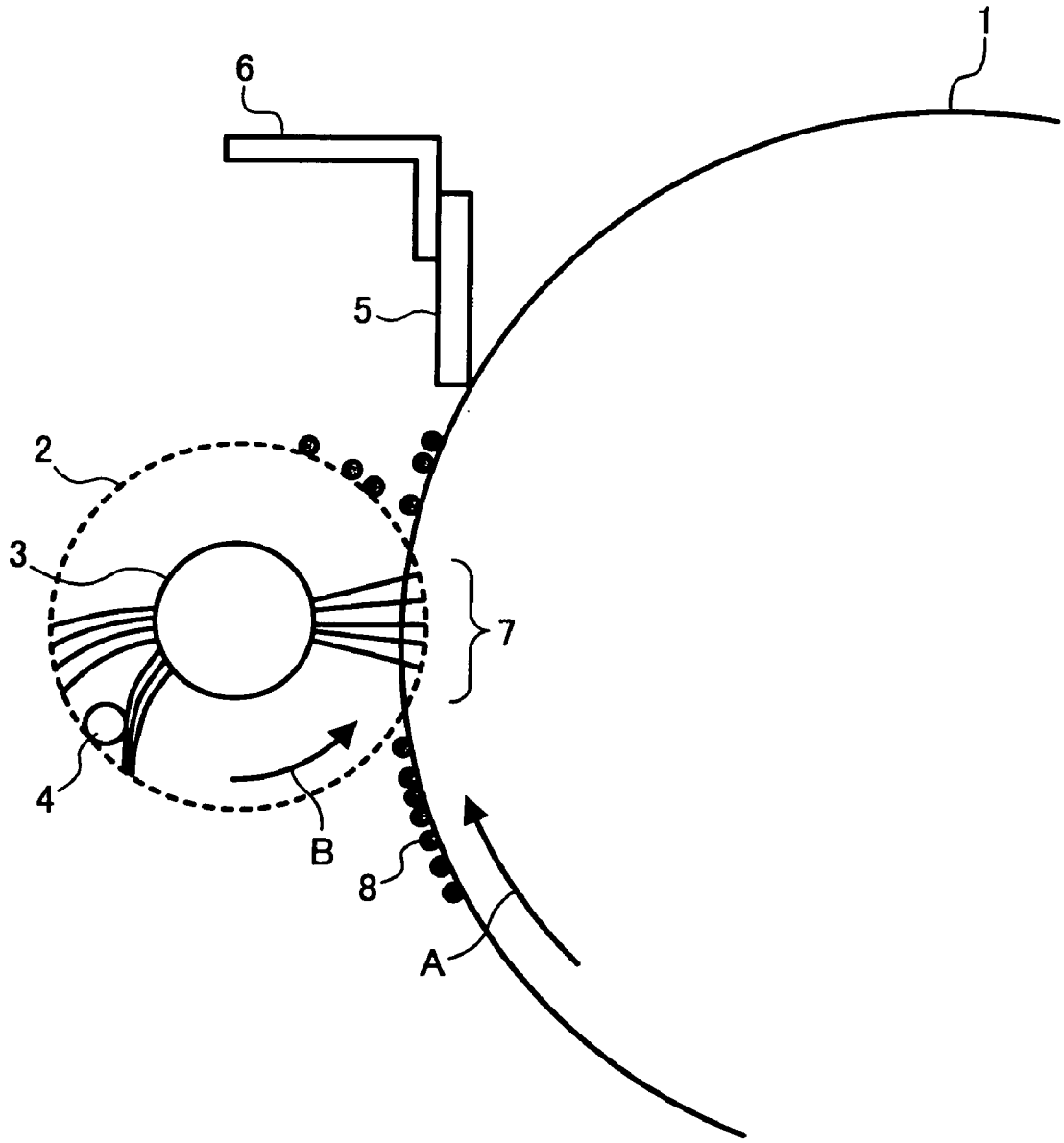
FIG. 1 is a schematic view illustrating an embodiment of the cleaner for use in the image forming apparatus of the present invention.

FIG. 1 is a schematic view illustrating an embodiment of the cleaner for use in the image forming apparatus of the present invention.

In FIG. 1, a photoreceptor 1 including a protective layer having good abrasion resistance rotates in a direction indicated by an arrow A, and a resin-impregnated cleaning brush 2 rotates in a direction indicated by an arrow B.

A cleaning blade 5 is fixedly held by a holder 6, and an edge thereof is contacted to the photoreceptor 1 upon application of a predetermined pressure in a counter direction to the rotation direction of the photoreceptor 1.

A cleaning brush 2 is located so as to form a brush nip 7 with the photoreceptor 1, and a predetermined bias may be applied to a shaft 3, or the shaft 3 may be earthed.

A residual toner 8 remaining on the surface of the photoreceptor, which has not been transferred by a transferer onto a transfer medium such as a transfer paper, is electrically transferred to the cleaning brush 2 by the bias applied to the shaft 3 at the brush nip 7. In addition, a part of the toner 8 is mechanically removed from the photoreceptor 1 by the rotation of the cleaning brush 2.

Thus, the toner 8 can effectively be removed electrically and mechanically regardless of its polarity and quantity. Then, materials in a shape of the filming (not shown), which are firmly fixed on the surface of the photoreceptor 1, can also be removed as the toner.

The cleaning brush 2 flicks the toner 8 with a flicker 4 buried on the cleaning brush 2, and the toner 8 is collected in a toner collection container (not shown).

The flicker is arranged so as to slap the brush to remove the toner accumulated among the brush fibers after the cleaning brush is repeatedly used.

The toner 8 is more effectively removed when there is a rotation speed difference between the surface of photoreceptor 1 and a tip of the brush.

Around the photoreceptor 1, a charger charging the photoreceptor 1, an irradiator irradiating the photoreceptor 1 to form an electrostatic latent image thereon, an image developer developing the electrostatic latent image with a toner to form a toner image thereon and a transferer transferring the toner image onto a transfer sheet, which are not shown, are arranged.

Figure 2:
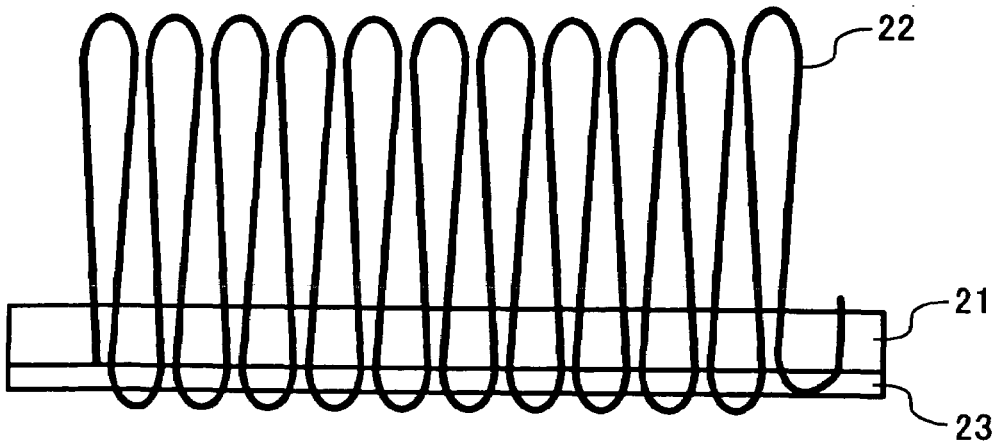
FIG. 2 is a schematic view illustrating a partial cross-section of an embodiment of the cleaning brush for use in the image forming apparatus of the present invention.

FIG. 2 is a schematic view illustrating a partial cross-section of an embodiment of the cleaning brush for use in the image forming apparatus of the present invention.

An embodiment of methods of preparing the cleaning brush will be explained, referring FIG. 2.

After an electroconductive fiber 22 is transplanted (implanted) on a base cloth 21 such that the fiber 22 has a loop top, a thermosetting resin liquid is coated on a back of the base cloth 21 to form a thermosetting resin layer 23 thereon to impregnate the base cloth 21 with the thermosetting resin.

When the thermosetting resin liquid is coated on the back of the base cloth 21, the liquid is absorbed by a surface of the fiber 22 due to the capillary phenomenon and the thermosetting resin liquid is coated on the whole surface of the electroconductive fiber 22. Then, the thermosetting resin liquid is dried and hardened upon application of heat.

Next, the thus prepared base cloth 21 is cut to have a predetermined size, the cut base cloth 21 is bonded to a rotatable shaft 3 while winded round the shaft to form a firm resin-impregnated cleaning brush.

When the thus prepared cleaning brush is used in an image forming apparatus, materials in a shape of the filming (not shown), which are firmly fixed on the surface of a photoreceptor, can also be removed as the toner.

The thermosetting resin is preferably used to prepare the cleaning brush of the present invention, but a similar effect can be expected from light-hardening resins or thermoplastic resins.

Specific examples of such resins include thermoplastic resins or thermosetting resins such as polystyrene, styrene/acrylonitrile copolymers, styrene/butadiene copolymers, styrene/maleic anhydride copolymers, polyester, polyvinyl chloride, vinyl chloride/vinyl acetate copolymers, polyvinyl acetate, polyvinylidene chloride, polyarylate, polycarbonate, cellulose acetate resins, ethyl cellulose resins, polyvinyl butyral, polyvinyl formal, polyvinyl toluene, acrylic resins, silicone resins, fluorine-containing resins, epoxy resins, melamine resins, urethane resins, phenolic resins and alkyd resins.

Suitable solvents for use in the thermosetting resin liquid include ketone such as methyl ethyl ketone, acetone, methyl isobutyl ketone, and cyclohexanone; ethers such as dioxane, tetrahydrofuran, and ethyl cellosolve; aromatic solvents such as toluene, and xylene; halogen-containing solvents such as chlorobenzene, and dichloromethane; esters such as ethyl acetate and butyl acetate; etc. These solvents can be used alone or in combination.

Particularly, methyl ethyl ketone, tetrahydrofuran and cyclohexanone are more preferably used than chlorobenzene, dichloromethane, toluene and xylene because of their low environmental burdens.

FIG. 2 shows the cleaning brush which is the electroconductive fiber 22 having a loop top, but a leiotrichous brush after the loop top is cut can also be used.

Synthetic fibers such as a nylon fiber, a polyester fiber, a styrene fiber and an acrylic fiber electroconductivity is imparted to can be used as the electroconductive fiber 22.

Next, the electrophotographic photoreceptor for use in the present invention will be explained.

Figure 3:
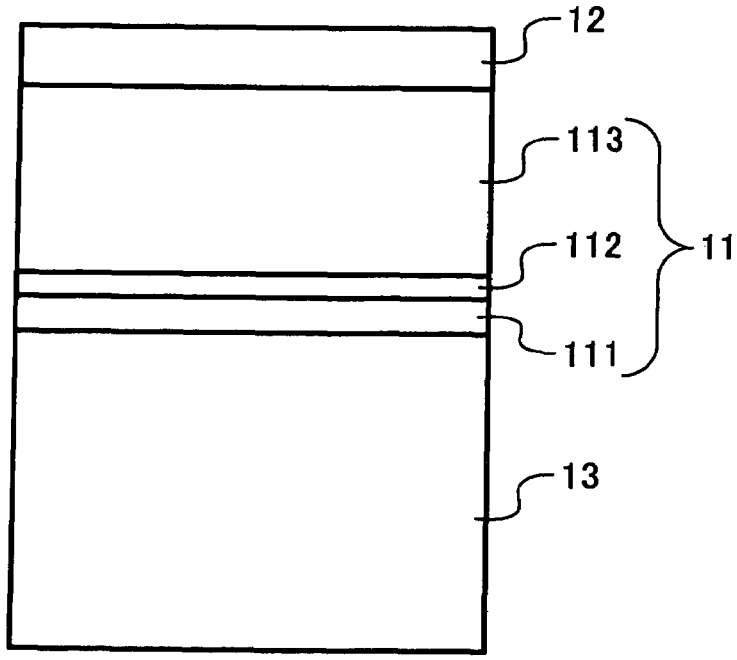
FIG. 3 is cross-sectional view of an embodiment of layers of the electrophotographic photoreceptor for use in the image forming apparatus of the present invention.

FIG. 3 is cross-sectional view of an embodiment of layers of the electrophotographic photoreceptor including a protective layer having good abrasion resistance.

The photoreceptor in FIG. 3 includes an electroconductive substrate 13, a photosensitive layer 11 thereon and a protective layer 12 having good abrasion resistance on the photosensitive layer.

The photosensitive layer 11 has a functionally-separated multilayered structure including a charge generation layer 112 and a charge transport layer 113, and optionally an undercoat layer 111. Further, the protective layer 12 may include a charge transport material mentioned later.

Suitable materials as the electroconductive substrate 13 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indiumoxides and the like, is deposited or sputtered. In addition, a plate of a metal such as aluminum, aluminum alloys, nickel and stainless steel and a metal cylinder, which is prepared by tubing a metal such as the metals mentioned above by a method such as drawing ironing, impact ironing, extruded ironing and extruded drawing, and then treating the surface of the tube by cutting, super finishing, polishing and the like treatments, can also be used as the substrate.

The photosensitive layer 11 in the present invention is preferably a multilayered photosensitive layer wherein the charge transport layer 113 is located overlying the charge generation layer 112.

First, the charge generation layer 112 will be explained.

The charge generation layer 112 is a part of the multilayered photosensitive layer, and has a capability of generating a charge when irradiated. The charge generation layer 112 includes a charge generation material as a main component, and optionally a binder resin. The charge generation material includes inorganic materials and organic materials.

Specific examples of the inorganic materials include crystalline selenium, amorphous selenium, selenium-tellurium alloys, selenium-tellurium-halogen alloys, selenium-arsenic alloys and amorphous silicone. The amorphous silicone prepared by terminating a dangling bond with a hydrogen atom or a halogen atom, or doping a boron atom or a phosphorus atom.

Specific examples of the organic charge generation materials include known materials, for example, phthalocyanine pigments such as metal phthalocyanine and metal-free phthalocyanine, azulenium pigments, squaric acid methine pigments, symmetric or asymmetric azo pigments having a carbazole skeleton, symmetric or asymmetric azo pigments having a triphenylamine skeleton, symmetric or asymmetric azo pigments having a diphenylamine skeleton, symmetric or asymmetric azo pigments having a dibenzothiophene skeleton, symmetric or asymmetric azo pigments having a fluorenone skeleton, symmetric or asymmetric azo pigments having an oxadiazole skeleton, symmetric or asymmetric azo pigments having a bisstilbene skeleton, symmetric or asymmetric azo pigments having a distyryloxadiazole skeleton, symmetric or asymmetric azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. Among these materials, the metal phthalocyanine, symmetric or asymmetric azo pigments having a fluorenone skeleton, symmetric or asymmetric azo pigments having a triphenylamine skeleton and perylene pigments are preferably used because they all have high charge generation quantum efficiency. These charge generation materials can be used alone or in combination.

Specific examples of the binder resin optionally used in the charge generation layer 112 include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. Among these resins, the polyvinyl butyral resins are mostly and preferably used. These resins can be used alone or in combination.

Suitable methods for forming the charge generation layer 112 are broadly classified into thin film forming methods in a vacuum and casting methods.

Specific examples of the former thin film forming methods in a vacuum include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods for forming the charge generation layer typically include the following steps:

(1) preparing a coating liquid by mixing one or more inorganic or organic charge generation materials mentioned above with a solvent such as tetrahydrofuran, cyclohexanone, dioxane, dichloroethane, butanone and the like, optionally together with a binder resin and an additive, and then dispersing the materials with a ball mill, an attritor, a sand mill or the like, to prepare a CGL coating liquid;

(2) coating the charge generation layer coating liquid, which is diluted if necessary, on a substrate by a method such as dip coating, spray coating, bead coating and ring coating; and (3) drying the coated liquid to form a charge generation layer.

The charge generation layer 112 preferably has a thickness of from about 0.01 to about 5 μm, and more preferably from about 0.05 to about 2 μm.

Next, the charge transport layer 113 will be explained.

The charge transport layer 113 is a part of the multilayered photosensitive layer, which receives a charge generated in the CGL, and transports the charge to a surface of a photoreceptor to neutralize a charge thereof. Main components of the charge transport layer 113 are a charge transport material and a binder resin binding this.

The charge transport layer 113 can be formed by dissolving or dispersing a mixture or a copolymer mainly formed of a charge transport material and a binder resin in a solvent to prepare a coating liquid; and coating and drying the coating liquid. Suitable coating methods include a dip coating method, a spray coating method, a ring coating method, a roll coating method, a gravure coating method, a nozzle coating method and a screen printing method.

The charge transport layer 113 preferably has a thickness of from 15 to 40 μm, and more preferably from 15 to 30 μm to have practically required sensitivity and charge ability, and most preferably from 15 to 25 μm when image resolution is required.

Since the protective layer 12 is formed on the charge transport layer 113, the charge transport layer 113 need not be designed in consideration of abrasion in practical use, and can be thin.

Suitable solvents for use in the charge transport layer 113 coating liquid include ketone such as methyl ethyl ketone, acetone, methyl isobutyl ketone, and cyclohexanone; ethers such as dioxane, tetrahydrofuran, and ethyl cellosolve; aromatic solvents such as toluene, and xylene; halogen-containing solvents such as chlorobenzene, and dichloromethane; esters such as ethyl acetate and butyl acetate; etc.

Particularly, methyl ethyl ketone, tetrahydrofuran and cyclohexanone are more preferably used than chlorobenzene, dichloromethane, toluene and xylene because of their low environmental burdens. These solvents can be used alone or in combination.

Specific examples of the polymers for use as the binder resin of the charge transport layer 113 include thermoplastic resins and thermosetting resins such as polystyrene, styrene/acrylonitrile copolymers, styrene/butadiene copolymers, styrene/maleic anhydride copolymers, polyester, polyvinyl chloride, vinyl chloride/vinyl acetate copolymers, polyvinyl acetate, polyvinylidene chloride, polyarylate, polycarbonate, cellulose acetate resins, ethyl cellulose resins, polyvinyl butyral, polyvinyl formal, polyvinyl toluene, acrylic resins, silicone resins, fluorine-containing resins, epoxy resins, melamine resins, urethane resins, phenolic resins and alkyd resins.

Particularly, polystyrene, polyester, polyarylate and polycarbonate are preferably used as a binder of a charge transport material because of their good charge transportability.

Since an outermost layer or a protective layer is overlaid on the charge transport layer 113, the charge transport layer 113 does not need mechanical strength as a conventional charge transport layer does. Therefore, such a polystyrene resin as has low mechanical strength although having high transparency, which has conventionally been difficult to use, can also be used effectively as the binder resin in the charge transport layer 113.

These polymer materials can be used alone or in combination. In addition, copolymers of the monomers of the polymer materials mentioned above can also be used. Further, copolymers of the monomers with a charge transport material can also be used.

Charge transport materials include electron transport materials and positive hole transport materials, which are further classified to charge transport polymer materials and low-molecular-weight charge transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds. These electron transport materials can be used alone or in combination.

Specific examples of the positive hole transport materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives, thiophene derivatives, and the like materials. These positive hole transport materials can be used alone or in combination.

The charge transport layer 113 can optionally include one or more low-molecular-weight compounds and leveling agents such as antioxidants, plasticizers, lubricants and ultraviolet absorbents. The low-molecular-weight compounds are preferably included therein in an amount of from 0.1 to 20 phr, and more preferably from 0.1 to 10 phr. The leveling agents are included therein in an amount of from 0.001 to 0.1 phr.

Next, the protective layer 12 will be explained.

The protective layer 12 includes a resin formed from a crosslinking reaction among a crosslinking charge transport material including a reactive hydroxyl group, a thermosetting resin monomer and a thermosetting surfactant.

The protective layer 12 preferably has a thickness not less than 1 μm, and more preferably not less than 2 μm.

Suitable solvents for use in preparing the protective layer 12 coating liquid include the ketone solvents, ether solvents, aromatic solvents, halogen-containing solvents and ester solvents. Particularly, methyl ethyl ketone, tetrahydrofuran and cyclohexanone are more preferably used than chlorobenzene, dichloromethane, toluene and xylene because of their low environmental burdens.

A charge transport material and a content thereof included in the protective layer 12 are the same as those used in the charge transport layer 112 mentioned above, but a resin reactive with the thermosetting resin needs to be included therein. Known surfactants can be included in the protective layer 12. Specific examples of the surfactants include (1) copolymers including (metha) acrylate having a fluoroalkyl group disclosed in paragraph [0017] of Japanese Laid-Open Patent Publication No.07-068398, such as block copolymers formed of a vinyl monomer not including a fluorine atom and a vinyl monomer including a fluorine atom disclosed in Japanese Laid-Open Patent Publications Nos. 60-221410 and 60-228588; and (2) fluorinated graft polymers such as comb graft polymers copolymerized with a methacrylate macro monomer having polymethylmethacrylate in its side chain and (metha)acrylate having a fluoroalkyl group disclosed in Japanese Laid-Open Patent Publication No. 60-187921.

These fluorine-containing resins are marketed as paint additives, such as resin surfactants SC-102 and SC-105 from Asahi Glass Co., Ltd. as fluorine-containing random copolymers.

Specific examples of fluorine-containing block copolymers include block copolymers formed of a polymer segment including a fluorinated alkyl group and an acrylic polymer segment, such as a marketed Modiper F series from NOF Corp., e.g., F100, F110, F200, f210 and F2020.

Specific examples of the fluorinated graft polymers include Aron Gf-150, GF-300 and RESEDA GF-2000 marketed by TOAGOSEI CO., LTD.

These surfactants can be used alone and can be also used as a crosslinking resin. Particularly, copolymers between methacrylate and fluoroalkyl acrylate are effectively used in the present invention.

The protective layer 12 may be a layer formed of an inorganic filler and a binder resin.

Specific examples of the inorganic filler include titanium oxide, silica, alumina, zinc oxide, zirconium oxide, tin oxide, indium oxide, antimony oxide, silicon nitride, boron nitride, calcium oxide, barium sulfate, etc.

The inorganic filler may be subjected to a surface treating agent for the purpose of improving dispersibility thereof in a coating liquid and a coated layer. Specific examples of typical surface treating agents include silane coupling agents, fluorine-containing silane coupling agents and higher fatty acids. In addition, a surface of the filler may be subjected to an inorganic material such as alumina, zirconia, tin oxide and silica.

Specific examples of the binder resin include an acrylic resin; a polyester resin; polycarbonate resins such as a bisphenol A carbonate resin, a bisphenol Z carbonate resin, a bisphenol C carbonate resin and their copolymers; a polyarylate resin; a polyamide resin; a polyurethane resin; a polystyrene resin; an epoxy resin; etc.

The protective layer 12 preferably includes the inorganic filler in an amount of from 3 to 50% by weight, and more preferably from 5 to 30% by weight. When less than 3% by weight, the resultant protective layer does not have sufficient abrasion resistance. When greater than 50% by weight, the resultant protective layer does not have sufficient transparency.

The "average abraded thickness" as used herein means an average abraded thickness of different places on the surface of a photoreceptor or an average abraded thickness of respective plural photoreceptors.

In the meantime, the "100,000 images" therein substantially means 100,000 revolutions of the photoreceptor when the number of revolutions thereof and the number of printed images are not accorded with each other.

As used herein, the term "overlying" includes contacting relation, but does not require it, nor does the term require coextensivity.

The protective layer 12 may be a layer formed of a crosslinked resin, wherein at least a radical polymerizing monomer without a charge transporting structure and a radical polymerizing compound with a charge transporting structure are hardened with a heat or a light energy.

The radical polymerizing monomer having without a charge transporting structure represents a monomer which has neither a positive hole transport structure such as triarylamine, hydrazone, pyrazoline and carbazole nor an electron transport structure such as condensed polycyclic quinone, diphenoquinone, a cyano group and an electron attractive aromatic ring having a nitro group, and has three or more radical polymerizing functional groups. Any radical polymerizing functional groups can be used, provided they have a carbon-carbon double bonding and capable of radically polymerizing.

Among these radical polymerizing function groups, the acryloyloxy groups and methacryloyloxy groups are effectively used. A compound having three or more acryloyloxy groups can be formed by, e.g., performing an ester reaction or an ester exchange reaction among a compound having three or more hydroxyl groups, an acrylic acid (salt), halide acrylate and ester acrylate. A compound having three or more methacryloyloxy groups can be formed by the same method.

Specific examples of the radical polymerizing monomer without a charge transporting structure include the following materials, but which are not limited thereto.

Namely, trimethylolpropanetriacrylate (TMPTA), trimethylolpropanetrimethacrylate, HPA-modified trimethylolpropanetriacrylate, EO-modified trimethylolpropanetriacrylate, PO-modified trimethylolpropanetriacrylate, caprolactone-modified trimethylolpropanetriacrylate, HPA-modified trimethylolpropanetrimethacrylate, pentaerythritoltriacrylate, pentaerythritoltetraacrylate (PETTA), glyceroltriacrylate, ECH-modified glyceroltriacrylate, EO-modified glyceroltriacrylate, PO-modified glyceroltriacrylate, tris(acryloxyethyl)isocyanurate, dipentaerythritolhexaacrylate (DPHA), caprolactone-modified dipentaerythritolhexaacrylate, dipentaerythritolhydroxypentaacrylate, alkyl-modified dipentaerythritolpentaacrylate, alkyl-modified dipentaerythritoltetraacrylate, alkyl-modified dipentaerythritoltriacrylate, dimethylolpropanetetraacrylate (DTMPTA), pentaerythritolethoxytetraacrylate, 2,2,5,5-tetrahydroxymethylcyclopentanonetetraacrylate, etc. are available. These can be used alone or in combination.

The radical polymerizing compound having with a charge transporting structure for use in the present invention is a compound which has a positive hole transport structure such as triarylamine, hydrazone, pyrazoline and carbazole or an electron transport structure such as condensed polycyclic quinone, diphenoquinone, a cyano group and an electron attractive aromatic ring having a nitro group, and has a radical polymerizing functional group. Specific examples of the radical polymerizing functional group include the above-mentioned radical polymerizing monomers, and particularly the acryloyloxy groups and methacryloyloxy groups are effectively used.

In addition, a triarylamine structure is effectively used as the charge transport structure. Further, when a compound having the following formula (1) or (2), electrical properties such as a sensitivity and a residual potential are preferably maintained.

(1)

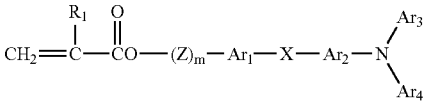

(2)

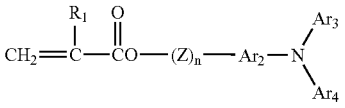

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkylene ether group, an oxygen atom, a sulfur atom and vinylene group; Z represents a substituted or an unsubstituted alkylene group, a substituted or an unsubstituted alkylene ether group and alkyleneoxycarbonyl group; and m and n represent 0 and an integer of from 1 to 3.

In the formulae (1) and (2), among substituted groups of $R_1$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc. These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups.

The substituted group of $R_1$, is preferably a hydrogen atom and a methyl group.

$Ar_3$ and $Ar_4$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group.

Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condensed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene and oxadiazole.

Specific examples of the substituted or unsubstituted aryl group represented by $Ar_3$ and $Ar_4$ include the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include methoxy groups, ethoxy groups, n-propoxy groups, I-propoxy groups, t-butoxy groups, s-butoxy groups, I-butoxy groups, 2-hydroxyethoxy groups, benzyloxy groups, trifluoromethoxy groups, etc.

(4) aryloxy groups, and specific examples of the aryl groups include phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

(6)

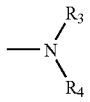

wherein $R_3$ and $R_4$ independently represent a hydrogen atom, an alkyl groups specified in (2) and an aryl group, and specific examples of the aryl groups include phenyl groups, biphenyl groups and naphthyl groups, and these may include an alkoxy group having 1 to 4 carbon atoms, an alkyl group having 1 to 4 carbon atoms or a halogen atom as a substituent, and $R_3$ and $R_4$ may form a ring together. Specific examples of the groups having this formula include amino groups, diethylamino groups, N-methyl-N-phenylamino groups, N,N-diphenylamino groups, N-N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc.

The arylene group represented by $Ar_1$ and $Ar_2$ are derivative divalent groups from the aryl groups represented by $Ar_3$ and $Ar_4$.

The above-mentioned X represents a single bond, a substituted or an unsubstituted alkylene group, a substituted or an unsubstituted cycloalkylene group, a substituted or an unsubstituted alkyleneether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include cyclohexylidine groups, cyclohexylene groups and 3,3-dimethylcyclohexylidine groups, etc.

Specific examples of the substituted or unsubstituted alkyleneether groups include ethylene oxy groups, propylene oxy groups, ethyleneglycol groups, propylene glycol groups, diethyleneglycol groups, tetraethylene glycol groups and tripropylene glycol groups. The alkylene group of the alkyleneether group may include a substituent such as a hydroxyl group, a methyl group and an ethyl group.

The vinylene group has the following formula:

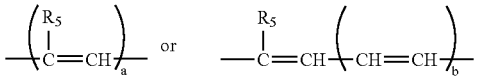

wherein R5 represents a hydrogen atom, an alkyl group (same as those specified in (2)), an aryl group (same as those represented by $Ar_3$ and $Ar_4$); a represents 1 or 2; and b represents 1, 2 or 3.

Z represents a substituted or an unsubstituted alkylene group, a substituted or an unsubstituted alkyleneether group and alkyleneoxycarbonyl group. Specific examples of the substituted or unsubstituted alkylene group include those of X. Specific examples of the substituted or unsubstituted alkyleneether group include those of X. Specific examples of the alkyleneoxycarbonyl group include caprolactone-modified groups.

The protective layer 12 can optionally include a polymerization initiator to effectively proceed the hardening reaction.

Specific examples of the heat polymerization initiators include peroxide initiators such as 2,5-dimethylhexane-2,5-dihydrooxide, dicumylperoxide, benzoylperoxide, t-butylcumylperoxide, 2,5-dimethyl-2,5-di(peroxybenzoyl)hexyne-3, di-t-butylbeloxide, t-butylhydrobeloxide, cumenehydobeloxide and lauroylperoxide; and azo initiators such as azobisisobutylnitrile, azobiscyclohexanecarbonitrile, azobisisomethylbutyrate, azobisisobutylamidinehydorchloride and 4,4'-azobis-4-cyanovaleric acid.

Specific examples of the photo polymerization initiators include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxi de, methylphenylglyoxyester, 9,10-phenanthrene, acridine compounds, triazine compounds and imidazole compounds. Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

These polymerization initiators can be used alone or in combination.

The protective layer 12 can optionally include one or more low-molecular-weight compounds and leveling agents such as antioxidants, plasticizers, lubricants and ultraviolet absorbents. The low-molecular-weight compounds are preferably included therein in an amount of from 0.1 to 50 parts by weight, and more preferably from 0.1 to 20 parts by weight per 100 parts weight of the binder resin. The leveling agents are preferably included therein in an amount of from 0.001 to 5 parts by weight per 100 parts weight of the binder resin.

The protective layer 12 can be formed by a dip coating method, a spray coating method, a ring coating method, a roll coating method, a gravure coating method, a nozzle coating method and a screen printing method. In particular, the spray coating method and ring coating method are preferably used because a charge transport layer including a fluorine-containing resin having desired properties can be stably produced. In the present invention, after the protective layer coating liquid is coated to form the protective layer 12, an external energy is applied thereto for hardening the layer. The external energy includes a heat, a light and a radiation. A heat energy is applied to the layer from the coated side or from the substrate using air, a gaseous body such as nitrogen, a steam, a variety of heating media, infrared or an electromagnetic wave. The heating temperature is preferably from 100 to 170° C. When less than 100° C., the reaction is slow in speed and is not completely finished. When greater than 170° C., the reaction nonuniformly proceeds and a large distortion appears in the cross linked surface layer. To uniformly proceed the hardening reaction, after heated at comparatively a low temperature less than 100° C., the reaction is completed at not less than 100° C. Specific examples of the light energy include UV irradiators such as high pressure mercury lamps and metal halide lamps having an emission wavelength of UV light; and a visible light source adaptable to absorption wavelength of the radical polymerizing compounds and photo polymerization initiators. An irradiation light amount is preferably from 50 to 1,000 $mW/cm^2$. When less than 50 $mW/cm^2$, the hardening reaction takes time. When greater than 1,000 $mW/cm^2$, the reaction nonuniformly proceeds and the crosslinked surface layer has a large surface roughness. The radiation energy includes a radiation energy using an electron beam. Among these energies, the heat and light energies are effectively used because of their simple reaction speed controls and simple apparatuses.

Further, photoreceptor 1 for use in the image forming apparatus of the present invention can optionally include an undercoat layer 111 between its substrate 13 and photosensitive layer 11.

The undercoat layer 111 typically includes a resin as a main component. However, since a photosensitive layer is typically formed on the undercoat layer by coating a liquid including an organic solvent, the resin in the undercoat layer preferably has good resistance against typical organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins, etc.

The undercoat layer may include a fine powder of metal oxides such as titanium oxide, silica, alumina, zirconium oxide, tin oxide and indium oxide; metal sulfides; and metal nitrides as a filler to maintain more stable charge ability of the resultant photoreceptor.

The undercoat layer can be formed by coating a coating liquid using a proper solvent and a proper coating method, and preferably has a thickness of from 0 to 10 μm, and more preferably from 0.2 to 6 μm.

Figure 4:
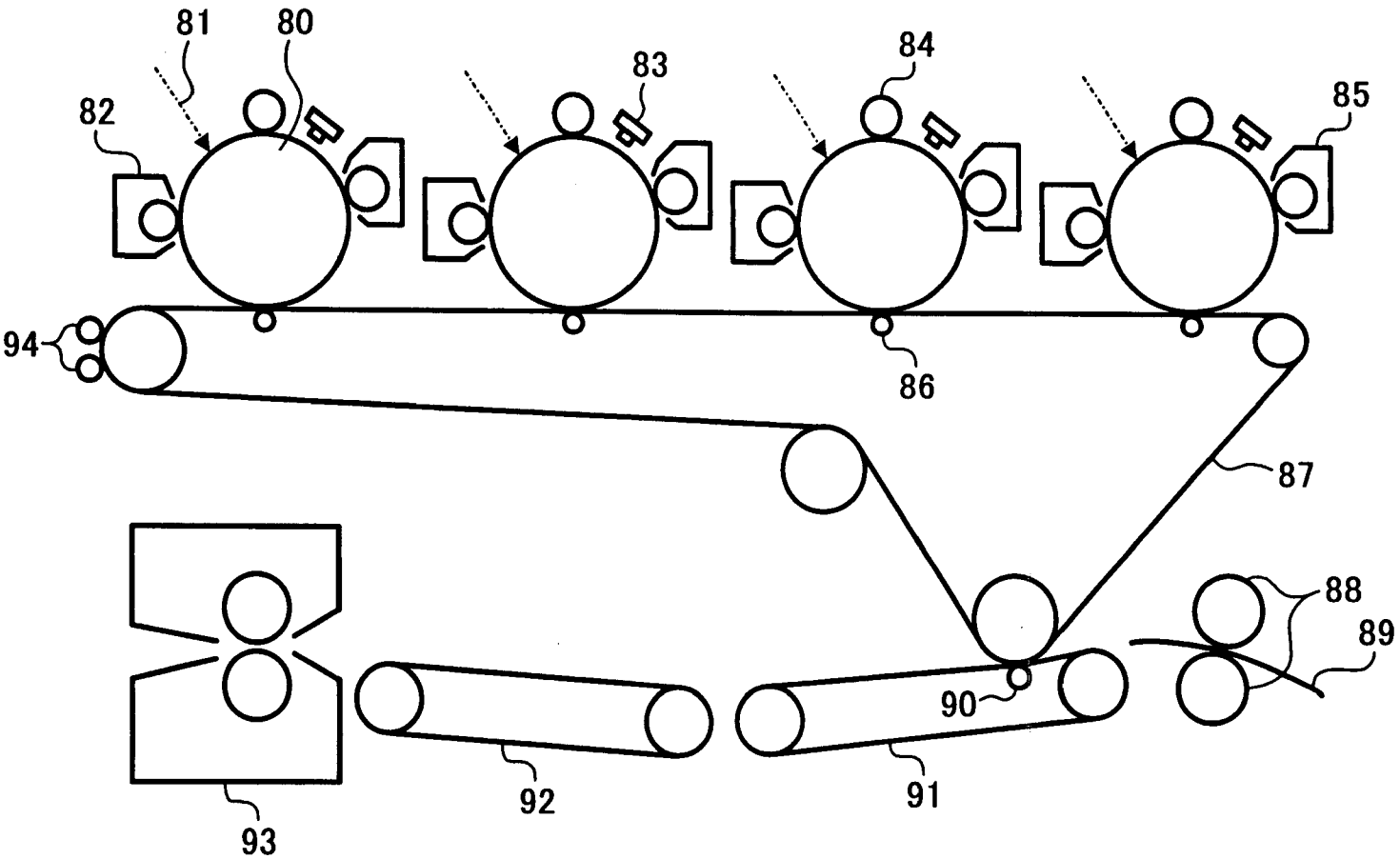
FIG. 4 is a schematic view illustrating the tandem-type full-color image forming apparatus using an intermediate transfer of the present invention.

FIG. 4 is a schematic view illustrating the tandem-type full-color image forming apparatus using an intermediate transfer of the present invention.

The tandem-type image forming apparatus includes an intermediate transfer belt 87, in which one photoreceptor is not shared by each color, and is equipped with photoreceptors 80Y, 80M, 80C and 80Bk for each color. In addition, the tandem-type image forming apparatus is also equipped with a photoreceptor cleaning unit 85 including the cleaner for use in the present invention, a discharging lamp 83 and a charging roller 84 uniformly charging the drum for each color. Numeral 81 is an imagewise light from an irradiator; 82 is an image developer; 86 is a bias roller; 88 is a resist roller; 89 is a paper (an image bearer); 90 is a paper transfer bias roller; 91 is a transfer belt; 92 is a transport belt; 93 is a fixing unit and 94 is a fur brush.

Further, the image forming apparatus of the present invention can detachably be equipped with a process cartridge including a photoreceptor and at least one of a charger, an irradiator, an image developer, a transferer, a cleaner and a discharger. The process cartridge of the present invention includes at least the photoreceptor and cleaner of the present invention.

This application claims priority and contains subject matter related to Japanese Patent Application No. 2003-429839 filed on Dec. 25, 2003, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

at least one electrophotographic photoreceptor comprising:

an electroconductive substrate, a photosensitive layer located overlying the electroconductive substrate, and a protective layer located overlying the photosensitive layer and serving as an outermost layer, wherein the protective layer has an average abraded thickness not greater than 1 μm after the electrophotographic image forming apparatus produces 100,000 images;

at least one charger configured to charge the at least one electrophotographic photoreceptor;

at least one irradiator configured to irradiate the at least one electrophotographic photoreceptor to form an electrostatic latent image thereon;

at least one image developer configured to develop the electrostatic latent image with a toner to form a toner image on the at least one electrophotographic photoreceptor;

at least one transferer configured to transfer the toner image onto a transfer sheet; and at least one cleaner configured to clean a surface of the at least one electrophotographic photoreceptor, wherein the cleaner comprises a cleaning brush comprising a base cloth implanted with at least one fiber and impregnated with a resin.

2. The image forming apparatus of claim 1, further comprising an intermediate transferer, wherein the electrophotographic image forming apparatus comprises:

a plurality of electrophotographic photoreceptors, and wherein the intermediate transferer receives toner images from the plurality of electrophotographic photoreceptors respectively and transfers the toner images onto the transfer sheet.

3. The image forming apparatus of claim 1, wherein the protective layer comprises a resin formed by subjecting a charge transport material having a reactive hydroxyl group, a thermosetting resin monomer, and a thermosetting surfactant to a crosslinking reaction.

4. The image forming apparatus of claim 1, wherein the protective layer comprises an inorganic filler and a binder resin.

5. The image forming apparatus of claim 1, wherein the protective layer comprises a crosslinked resin formed by subjecting a radical polymerizing monomer not having a charge transporting structure and a radical polymerizing compound having a charge transporting structure to a crosslinking reaction using heat or light.

6. The image forming apparatus of claim 1, wherein the cleaning brush is electroconductive and rotatable to electrically and mechanically remove a residual toner and a foreign particle from a surface of the protective layer of the electrophotographic photoreceptor while rotating and applying bias thereto or being grounded.

7. The image forming apparatus of claim 1, wherein the at least one fiber is electroconductive;

the cleaning brush further comprises a rotatable shaft; and the base cloth is located on the rotatable shaft.

8. The image forming apparatus of claim 7, wherein the resin is a thermosetting resin.

9. An image forming method, comprising: charging an electrophotographic photoreceptor;

irradiating the electrophotographic photoreceptor to form an electrostatic latent image thereon;

developing the electrostatic latent image with a toner to form a toner image on the electrophotographic photoreceptor;

transferring the toner image onto a transfer sheet; and cleaning a surface of the electrophotographic photoreceptor in an image forming apparatus, wherein the image forming apparatus is the image forming apparatus according to claim 1.

10. The image forming apparatus of claim 1, wherein the resin is coated on the whole surface of the at least one fiber.

11. The image forming apparatus of claim 1, wherein the cleaning brush is leiotrichous.

* * * * *